US008192244B2

(12) United States Patent
Cannon

(10) Patent No.: US 8,192,244 B2
(45) Date of Patent: Jun. 5, 2012

(54) WATER SPORTS BINDING ASSEMBLY

(75) Inventor: Douglas A. Cannon, Arlington, WA (US)

(73) Assignee: Connelly Skis, Inc., Lynwood, WA (US)

( * ) Notice: Subject to any disclaimer, the term of this patent is extended or adjusted under 35 U.S.C. 154(b) by 513 days.

(21) Appl. No.: 12/552,119

(22) Filed: Sep. 1, 2009

(65) Prior Publication Data

US 2009/0325435 A1 Dec. 31, 2009

Related U.S. Application Data

(63) Continuation-in-part of application No. 11/817,402, filed as application No. PCT/US2006/032075 on Aug. 15, 2006, now Pat. No. 7,699,678, which is a continuation of application No. 11/206,253, filed on Aug. 16, 2005, now Pat. No. 7,134,928.

(51) Int. Cl.

| | |
|---|---|
| ***A63C 9/00*** | (2006.01) |
| ***A63C 9/08*** | (2006.01) |
| ***A63C 9/24*** | (2006.01) |
| ***B63B 35/85*** | (2006.01) |

(52) U.S. Cl. ..... 441/70; 280/617

(58) Field of Classification Search ..... 441/70; 280/617–634, 14.22, 14.23

See application file for complete search history.

(56) References Cited

U.S. PATENT DOCUMENTS

| | | | | |
|---|---|---|---|---|
| 3,143,750 | A | | 8/1964 | Kluge |
| 3,360,812 | A | | 1/1968 | Kluge |
| 3,839,758 | A | | 10/1974 | Jack |
| 4,095,356 | A | | 6/1978 | Robran |
| 4,131,963 | A | | 1/1979 | Johnson |
| 4,168,084 | A | * | 9/1979 | von Besser et al. ..... 280/618 |
| 4,265,034 | A | | 5/1981 | Salomon |
| 4,575,957 | A | | 3/1986 | Petrini |
| 4,869,697 | A | | 9/1989 | Ackert |
| 4,972,613 | A | | 11/1990 | Loveder |
| 5,277,635 | A | | 1/1994 | Gillis |
| 5,354,088 | A | | 10/1994 | Vetter |
| 5,356,170 | A | | 10/1994 | Carpenter |
| 5,417,443 | A | | 5/1995 | Blattner |
| 5,624,291 | A | | 4/1997 | McClaskey |
| 5,660,410 | A | | 8/1997 | Alden |
| 5,909,886 | A | | 6/1999 | Tugutaka |
| 5,913,530 | A | | 6/1999 | Berger |
| 5,947,781 | A | | 9/1999 | VonWald |
| 6,007,077 | A | | 12/1999 | Moe |
| 6,017,256 | A | | 1/2000 | Gillis |
| 6,095,881 | A | | 8/2000 | Neubauer |
| 6,174,212 | B1 | | 1/2001 | Chang |
| 6,336,650 | B1 | | 1/2002 | Alspaugh |
| 6,390,492 | B1 | | 5/2002 | Bumgarner |
| 6,557,865 | B1 | | 5/2003 | Reuss |

(Continued)

*Primary Examiner* — Ajay Vasudeva

(74) *Attorney, Agent, or Firm* — Christensen O'Connor Johnson Kindness PLLC

(57) ABSTRACT

A binding for water sports comprises a baseplate, which may optionally include a toe cup, and a heel cup. A heel loop is pivotably attached to the heel cup, and is pivotable between an upper position and a lower position to adjust the amount of support provided to the user's ankle. An adjustment control, for example a lever and cam mechanism pivotably attaches to the heel cup and is positioned such that the user can selectively move the cam portion between a release position wherein the heel loop is not supported in the upper position, and a support position wherein the heel loop is supported in the upper position. A flexible upper portion is attached to the base plate.

17 Claims, 14 Drawing Sheets

U.S. PATENT DOCUMENTS

| | | | | |
|---|---|---|---|---|
| 6,641,163 | B2 | 11/2003 | Joubert des Ouches | |
| 6,659,493 | B1 | 12/2003 | Trnka | |
| 6,726,238 | B2 | 4/2004 | Poscich | |
| 6,739,615 | B1 | 5/2004 | Maravetz | |
| 6,855,023 | B2 | 2/2005 | Berger | |
| 6,955,362 | B2 | 10/2005 | Bazzi | |
| 7,134,928 | B1 | 11/2006 | Cannon | |
| 7,147,233 | B2 | 12/2006 | Edmond | |
| 7,159,892 | B2 | 1/2007 | Draper | |
| 7,246,811 | B2 | 7/2007 | Martin | |
| 7,699,678 | B2 * | 4/2010 | Cannon | 441/70 |

* cited by examiner

WATER SPORTS BINDING ASSEMBLY

CROSS-REFERENCES TO RELATED APPLICATIONS

This application is a continuation-in-part of U.S. application Ser. No. 11/817,402, filed Aug. 29, 2007, now U.S. Pat. No. 7,699,678, which is the National Stage of International Application No. PCT/US06/32075, filed Aug. 15, 2006, which is a continuation of U.S. application Ser. No. 11/206,253, filed Aug. 16, 2005, now U.S. Pat. No. 7,134,928, issued Nov. 14, 2006, the disclosures of which are hereby incorporated by reference in their entirety as if set forth fully herein.

BACKGROUND

Water skis, wake boards, and other water sporting boards generally require a binding that releasably attaches the user to the water sports board. Typically, a user rides a wake board while being towed behind a boat or jet ski. The wake board resembles a surf board but, unlike a surf board, the wake board includes bindings that attach the feet of a rider onto the top surface of the wake board.

One challenge associated with bindings for wake boards and water skis is that the binding must securely hold the rider's foot in contact with the wake board during rigorous use and during relatively benign falls, but must be flexible enough to allow release of the rider upon a sufficiently violent fall. Prior art bindings addressed these problems in a number of ways. For example, some water sports bindings are designed primarily of an elastic material that is stretchable to fit and grip many different foot sizes, but is sufficiently stretchable to release the foot upon a sufficiently dynamic fall. These designs are often uncomfortable, however, because the stretchable material is tensioned around the entire foot to hold the rider in place. An example of a prior art wake board binding having this construction can be found in U.S. Pat. No. 5,624,291 to McClaskey. The wake board binding in McClaskey includes two strips that are attached at the top of the wake board on opposite sides of a heel of a rider. The strips extend upward around the instep of the rider and are attached by hook-and-loop material. Attachment of the two strips binds the rider's foot to the upper surface of the wake board and maintains the rider's foot against the upper surface.

Another type of water ski or wake board binding is formed primarily of a semirigid material. For example, the two patents to Uren et al. (U.S. Pat. Nos. 5,181,332 and 5,334,065) disclose a water ski boot and binding including rigid side panels or cowls, rigid heel supports, and straps mounted over the instep of a rider's foot. A rigid cuff extends around the ankle of the rider that is made as a monolithic tube of stiff, semirigid, or substantially rigid plastic material. A problem with this design is that it does not permit release of the rider's foot, but instead, the boot releases from the ski upon a fall.

In yet another type of water sports binding, a releasable boot is worn by the user, wherein the boot is attachable to the binding. An example of this type of binding is found in U.S. Pat. No. 6,855,023 to Berger et al, wherein a coupling is attached to the sole of the boot, the coupling being adapted to mate with a second coupling attached to a lower attachment plate. These bindings require the user to wear relatively heavy and uncomfortable boots in the water and have not gained wide acceptance.

All of the prior art water sports bindings are difficult or impossible to engage while in the water, so if a user falls and releases from the binding, the user may have to return to shore or onto the pulling watercraft to re-engage the binding to continue the sport. There remains a need for water sports bindings that provide the functional benefits of a binding and that also are relatively easy to engage while in the water.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A water sports binding is disclosed for releasably attaching a user's foot to a water sports board. The binding include a base plate that is configured for attachment to the water sports board. A heel loop is pivotably attached to the base plate, and positioned to generally extend around the back of the user's foot and/or ankle. The heel loop is adapted to pivot about a transverse between a first or support position and a second or release position. A flexible upper assembly is attached to the base plate. An adjustment control mechanism, preferably a lever and cam type of control, is pivotably attached to the base plate, and positioned such that the adjustment control mechanism can move the heel loop from the release position to the support position such that the control supports the heel loop in the support position. When the adjustment control mechanism is moved to the release position it does not support the heel loop.

In one embodiment, the base plate includes an upright heel cup portion that pivotably mounts the heel loop, and that also pivotably mounts the adjustment control mechanism. When the adjustment control mechanism is moved to the support position, the heel loop is moved to a position that more securely engages the user's ankle. When the heel loop is in the release position, in one embodiment the user's ankle is less firmly supported, which may be preferable for certain water sports activities or user skill levels. In another embodiment, the heel loop is moved to the release position to facilitate entry or exit from the binding.

In an embodiment, the binding for releasably attaching a user's foot to a water sports board comprises a base plate having a heel portion and a toe cup. A heel loop is attached to the base plate and pivotably between a support position and a release position. A flexible upper assembly is attached to the base plate. An adjustment control mechanism includes a cam portion that engages the heel loop and pivots between a first position wherein the adjustment control mechanism supports the heel loop in the support position and a second position wherein the adjustment control mechanism does not support the heel loop.

In an embodiment, the binding includes a base plate having a heel portion and a toe cup, and a heel loop pivotably attached to the base plate. The heel loop pivots between a support position wherein a rearward portion of the heel loop is disposed toward the base plate, and a release position where the rearward portion of the heel loop is disposed relatively farther away from the base plate. An adjustment control mechanism is pivotably attached to the base plate and includes a cam portion that is pivotable between a first position wherein the adjustment control mechanism supports the heel loop in the support position and a second position wherein the adjustment control mechanism does not support the heel loop.

The base plate may further include a heel cup extending upwardly from the heel portion of the base plate, and the adjustment control mechanism includes a lever that is pivotably mounted to the heel cup such that the cam underlies the heel loop.

In an embodiment, the cam includes an eccentric portion that depends away from the lever and a spaced leg portion that depends away from the eccentric portion.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

A currently preferred embodiment of a water sports binding 100 according to the present invention will now be described with reference to the figures, wherein like numbers indicate like parts.

Figure 1:
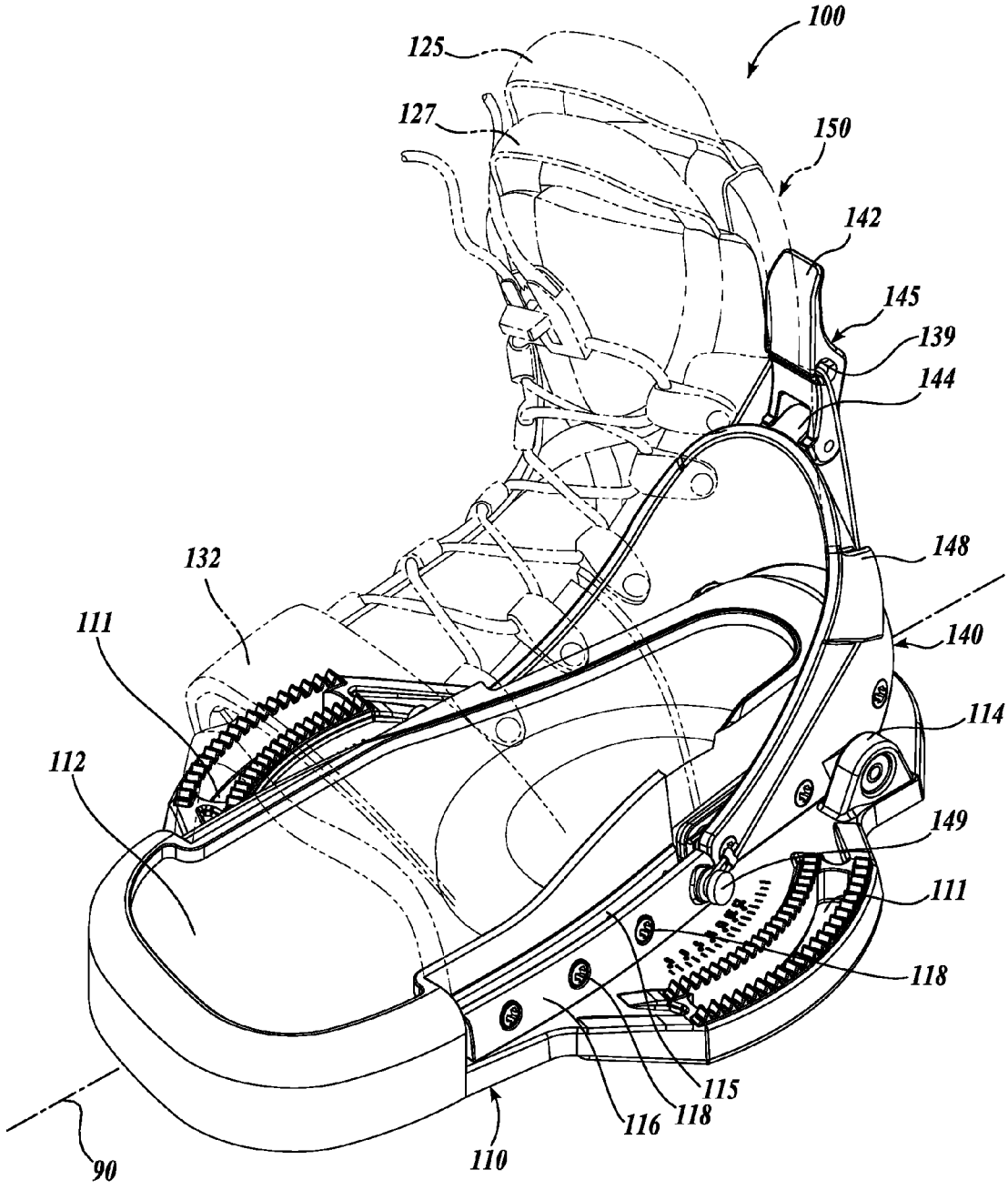
FIG. 1 is a perspective view of a water sports binding according to the present invention, with the generally pliable upper portions of the binding shown in phantom.
Figure 2:
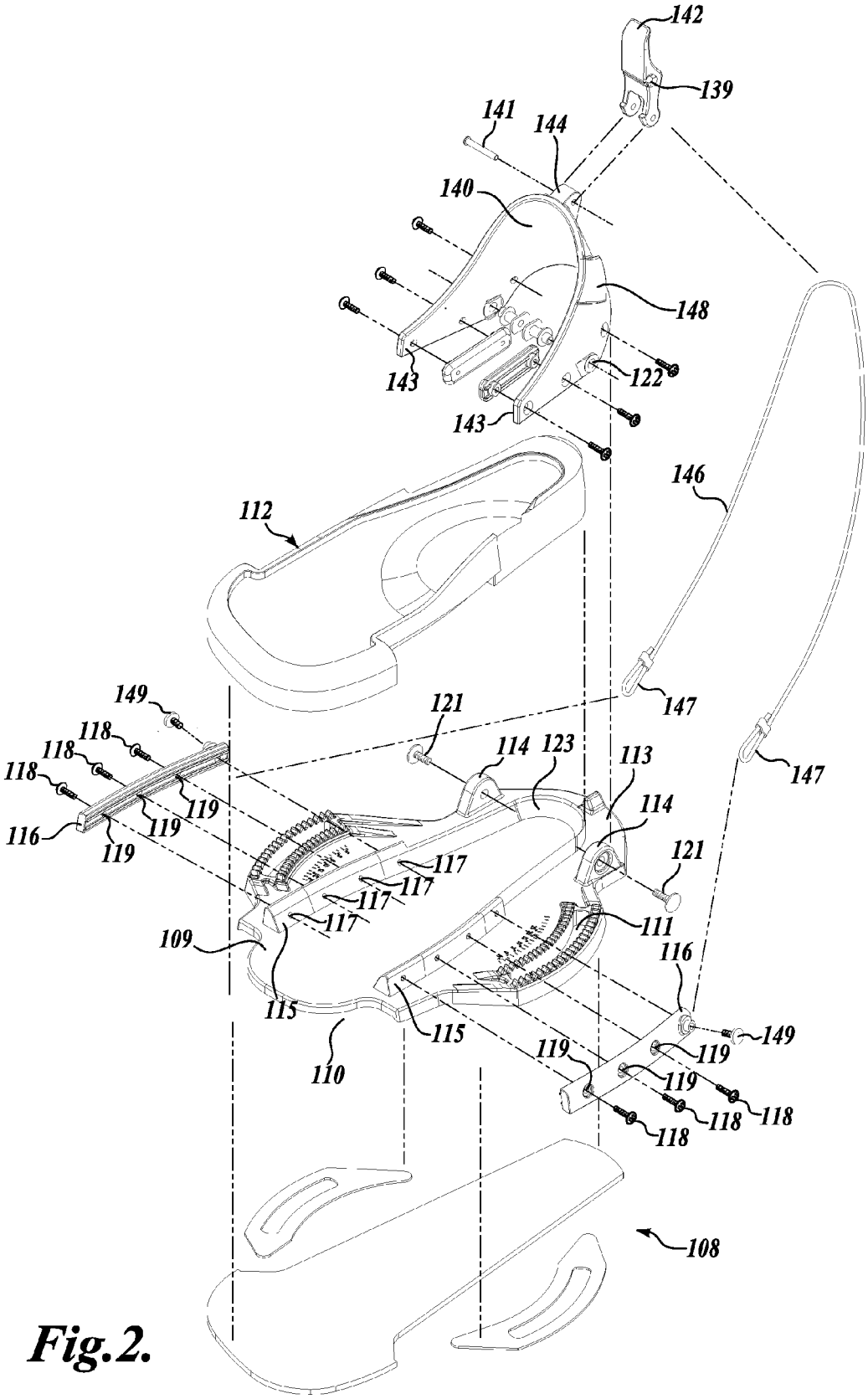
FIG. 2 is an exploded view of the water sports binding shown in FIG. 1, wherein the generally pliable upper portions are removed for clarity.

Referring first to FIGS. 1 and 2, FIG. 1 shows a perspective view of the water sports binding 100, wherein the flexible upper assembly 150 is shown in phantom to better expose certain novel aspects of the present invention. An exploded view of the binding 100 with the upper assembly 150 removed for clarity is shown in FIG. 2. Although the water sports binding 100 described in this embodiment is intended for use with a wake board (not shown), it is contemplated that the present invention may also be practiced with other water sports boards, including water skis and the like.

The binding 100 includes a substantially rigid base plate 110 that is adapted to be adjustably mounted on a wake board, the base plate 110 having a front or toe end 109 and a back or heel end 113. In a current embodiment, the base plate 110 is formed from a composite material, such as a glass-filled nylon composite, although other suitable materials are appropriate and within the skill in the art to identify. A vibration-absorbing pad 108, which may be a unitary pad or formed in multiple portions (three portions shown), underlies the base plate 110. The base plate 110 includes oppositely-disposed, curved, elongate apertures or slots 111 such that the angular position of the base plate 110 on the wake board may be selectively fixed using conventional attachment hardware (not shown). Other configurations for attaching the base plate 110 to a wake board are also contemplated and are well-known in the art including, for example, using a plurality of spaced apertures rather than elongate slots. A relatively thick foot pad 112 is provided on top of the base plate 110 and is preferably affixed to the base plate 110. The foot pad 112 is preferably formed from closed-cell polymeric foam and may extend beyond the toe end 109 of the base plate 110.

The base plate 110 includes left and right inner attachment rails 115 that extend upwardly from the base plate 110. In the current embodiment the attachment rails 115 are connected by a rib portion 123 that extends generally around towards the heel end 113 of the base plate 110, stiffening the base plate 110. The inner attachment rails 115 include a plurality of threaded apertures 117. The inner attachment rails 115 may be separable components—for example, elongate members attached to the base plate 110 with conventional attachment hardware (not shown) extending through the bottom of the base plate 110. In the current embodiment, the inner attachment rails 115 are integrally formed with the base plate 110. Left and right outer attachment rails 116 are releasably attachable to the corresponding inner attachment rails 115—for example, using bolts 118 that extend through apertures 119 in the outer attachment rails 116 and engage the threaded apertures 117. It will be apparent to those of skill in the art that the inner and outer attachment rails 115, 116 are suitable for attaching portions of the upper assembly 150 to the base plate 110, as discussed below.

A rigid U-shaped heel loop 140 is pivotably attached to the base plate 110. In the preferred embodiment, the heel loop 140 is attached through a pair of oppositely-disposed lugs 114 extending upwardly from the base plate 110. The heel loop 140 may also be formed, for example, from a glass-filled nylon. Pivot pins 121 (including conventional attachment hardware) extend through each lug 114 and through a corresponding aperture 122 in a lower portion of the heel loop 140, such that the heel loop 140 is pivotable relative to the base plate 110 through an angle about an axis transverse to the longitudinal axis 90 of the binding 100. The heel loop 140 includes oppositely-disposed forward leg portions 143 that abut the base plate 110 to limit the forward pivoting of the heel loop 140.

A lever mechanism 145 allows the pivotable heel loop 140 to be locked in an upright position during use. The lever mechanism 145 includes a lever 142 that is pivotably mounted on the back of the heel loop 140 through an integral center lug 144 and using pivot pin mounting hardware 141. The lever 142 is movable between a first position (the upper position in FIG. 3), wherein the heel loop 140 is held in the upright position, and a second position, wherein the heel loop 140 is pivotable rearwardly. The lever 142 includes a channel 139 that slidably engages a cable 146 having loop portions 147 at each end that attach to posts 149 fixed on opposite sides of the base plate 110. A pair of cable guides 148 (one visible in the figures) is mounted to the heel loop 140 intermediate of the leg portions 143 and the lever 142 to position and retain the cable 146. It will be appreciated that the length of the cable 146 is selected such that when the lever 142 is in the first (upper) position shown in FIG. 3, the tension in the cable 146 urges the lever toward the heel loop 140 such that the lever 146 tends to stay in the first position and the heel loop 140 is held in the upright position wherein the leg portions 143 abut the base plate 110.

Figure 3:
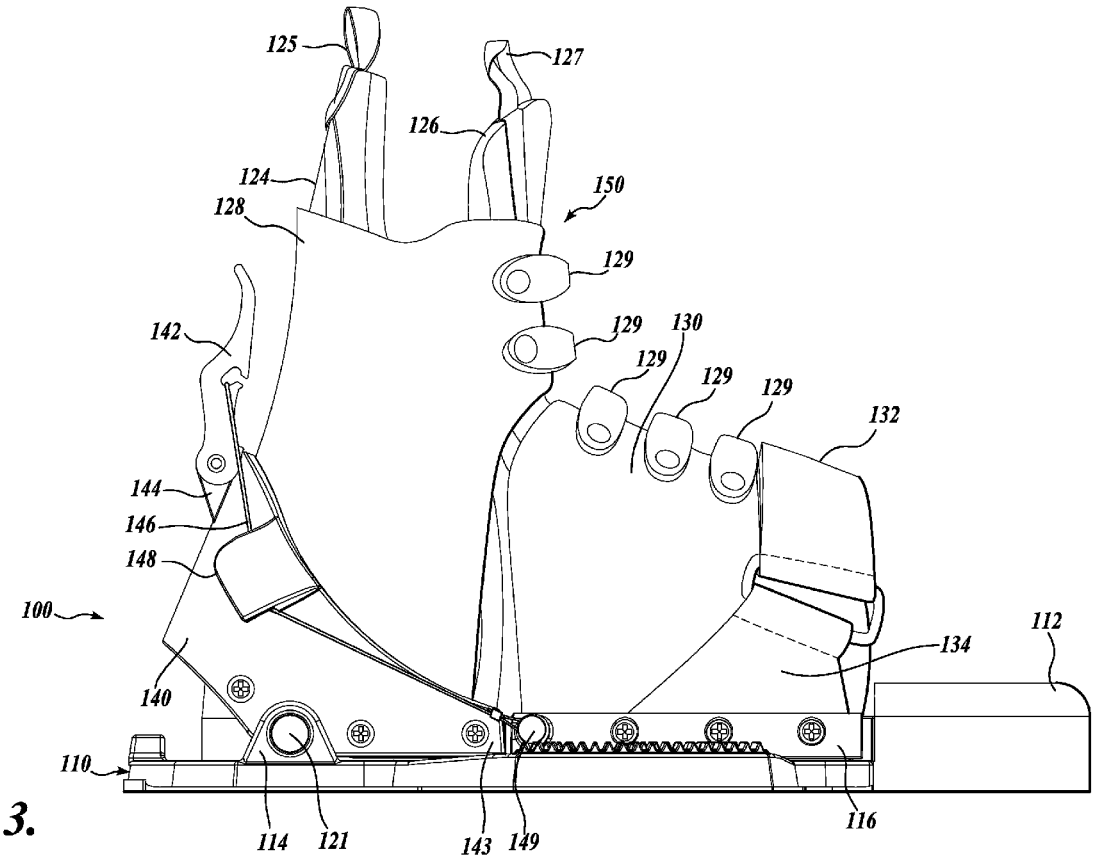
FIG. 3 is a side view of the water sports binding shown in FIG. 1.

Referring in particular now to FIG. 3 that shows a side view of the binding 100, the flexible upper assembly 150 of the preferred embodiment will now be described. The upper assembly 150 is made substantially from pliable elements that comfortably and securely engage a user's foot. The upper assembly 150 of the preferred embodiment includes a forward portion attached to the base plate 110 and a rearward portion attached to the heel loop 140. A back panel 124 extends upwardly behind the foot and ankle of the user and is attached to the base plate 110 through the pivotable heel loop 140. The back panel 124 is curved about an upright axis to generally conform to the back of the user's foot and leg and optionally includes a pull loop 125 fixedly attached at an upper end of the back panel 124. A front panel 126 extends upwardly from the base plate 110 and is attached to the base plate 110 by clamping between the inner and outer attachment rails 115, 116 described above (FIG. 2). The front panel 126 overlies the user's instep and front ankle and optionally includes a second pull loop 127 fixedly attached to the top end of the front panel 126. The back panel 124 and front panel 126 may be formed from a closed-cell, polymeric foam material to substantially wrap the user's ankle in a comfortable and flexible assembly and may include a relatively soft and compressible inner portion that is permanently adhered to a denser and less compressible outer portion.

A relatively sturdy ankle support 128 is attached to the heel loop 140 between the back panel 124 and the heel loop 140. The ankle support 128 is preferably formed from a rubbery polymeric material and wraps generally around the user's ankle. A plurality of keepers 129 is attached to the ankle support 128, whereby the ankle support 128 can be fixed about the user's ankle with a lace (not shown). Alternatively, a strap with an alternative attachment mechanism, such as a hook-and-loop type material or a mechanical clasp, may be used to adjustably attach the ankle support 128 about the user's ankle.

Similarly, relatively sturdy left and right instep supports 130 (right instep support visible in FIG. 3) are attached to the base plate 110 between the inner attachment rail 115 and outer attachment rail 116. The left and right instep supports 130 may be formed from the same material as the ankle support 128 and extend generally over the user's instep. A plurality of keepers 129 is provided such that the instep support 130 can be adjustably fixed about the user's instep with the lace (not shown) to comfortably secure the user to the binding 100. It will be readily apparent that alternative attachment means may be utilized as discussed above. In the disclosed embodiment an optional forward toe strap 132 is also provided. The optional toe strap 132 is substantially inelastic and is adjustably attached to strap supports 134 disposed on either side of the base plate 110 (one visible in FIG. 3). The strap supports 134 are attached to the base plate 110 through the inner attachment rail 115 and outer attachment rail 116. The toe strap 132 of the preferred embodiment is adjustably secured about the user's foot using hook-and-loop type panels (not shown). In another preferred embodiment the binding does not include a toe strap.

Figure 4:
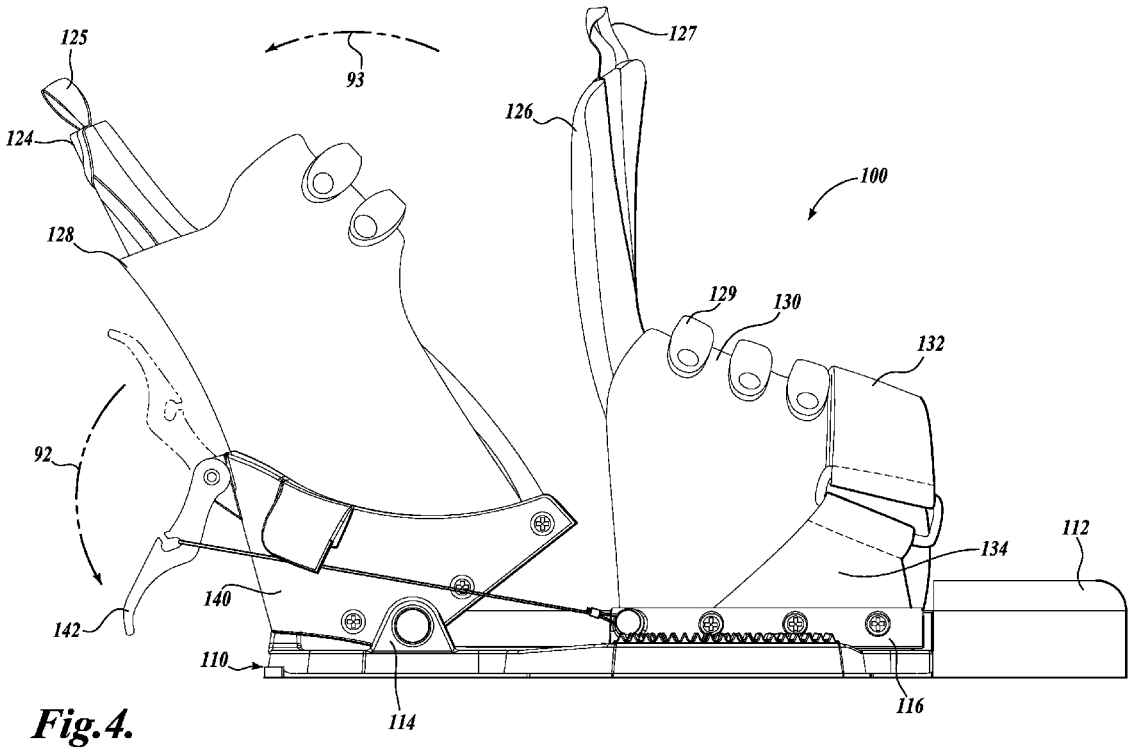
FIG. 4 is a side view of the water sports binding shown in FIG. 1 and showing the heel loop pivoted to the release position.

A novel aspect of the binding 100 is the heel loop 140 that is pivotably attached to the base plate 110. As shown in FIG. 4, to facilitate entry or egress from the binding 100, the user moves the lever 142 from the first (upper) position (shown in phantom in FIG. 4) to the release or second position, as indicate by arrow 92. This loosens the tension in the cable 146, thereby permitting the user to pivot the heel loop 140 rearwardly, as indicated by arrow 93. The back panel 124 and ankle support 128 are attached to the heel loop 140 and, therefore, pivot with the heel loop 140 away from the front panel 126 and instep support 130. This action opens the binding 100, allowing the user to easily engage or disengage from the binding 100. When engaging the binding 100, the user inserts a foot between the foot pad 112 and the front panel 126 (which may be greatly facilitated by using pull loops 125, 127) and pivots the lever 142 from the second or lower position back to the first or upper position.

It will be apparent to persons of skill in the art that the present invention provides substantial benefits for water sports applications, wherein a user may frequently wish to engage the binding 100 while floating in the water. In prior art bindings, the elasticity of the upper assembly is typically relied upon to provide sufficient stretching to allow the user to insert a foot, while also providing sufficient binding forces to securely retain the user's foot. The present invention eases the process of engaging the binding so that a user can quite easily reenter the binding while in the water. It will also be appreciated that, in embodiments wherein the heel loop 140 is rigid, the heel loop 140 also provides the user with improved leverage on the water sports board, which can improve the user's comfort and ease in manipulating the board during use.

Figure 5:
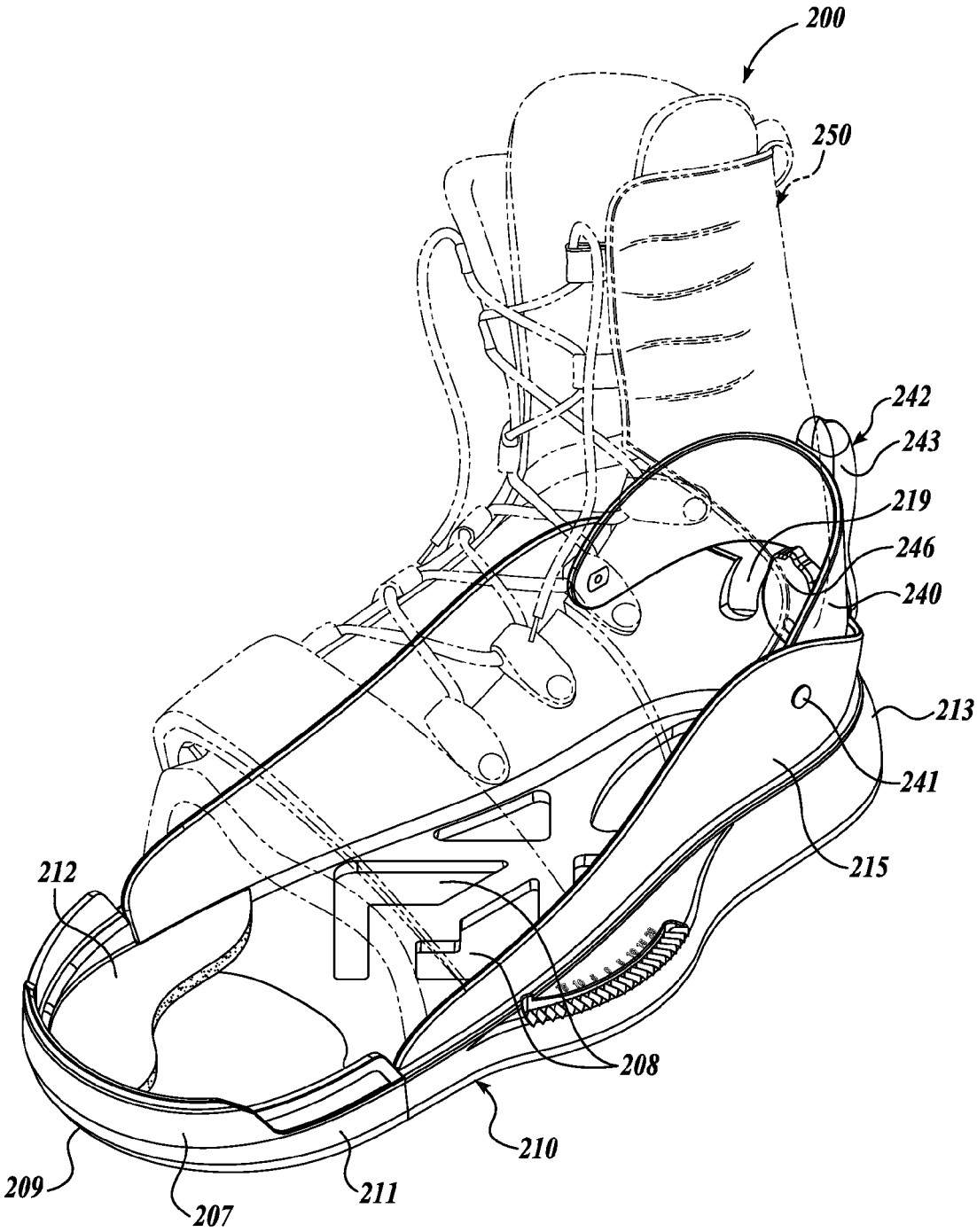
FIG. 5 is a perspective view of a second embodiment of a water sports binding in accordance with the present invention with the soft upper portions shown in phantom.
Figure 6:
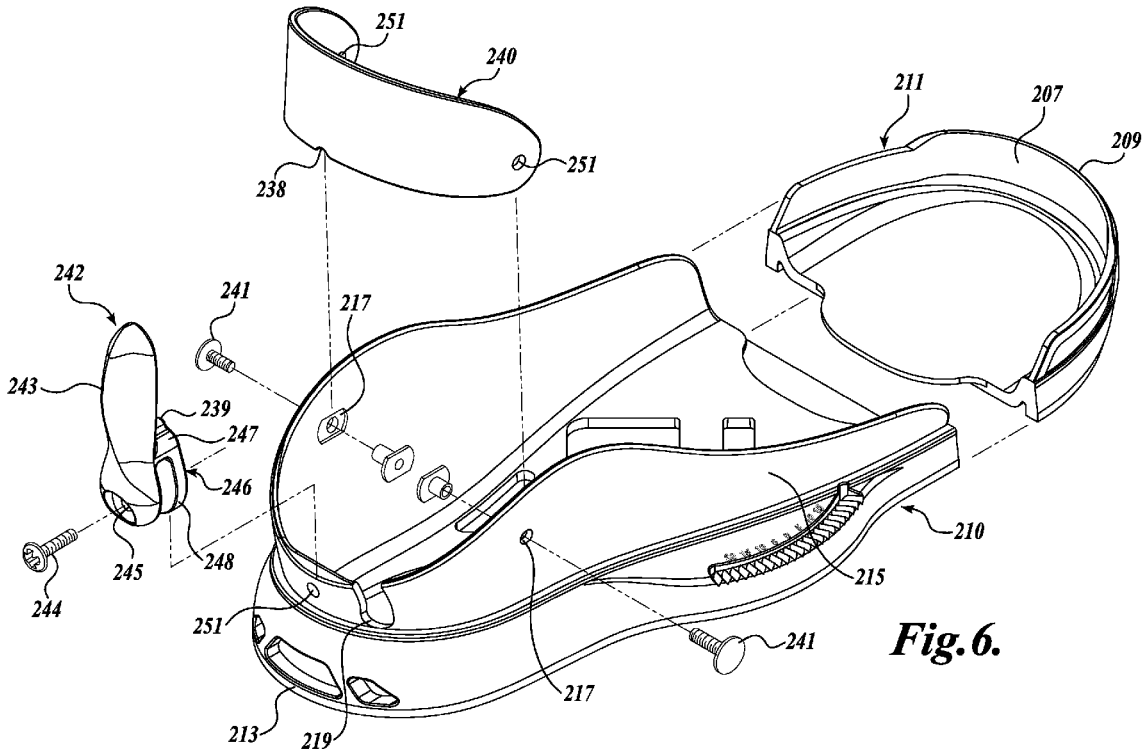
FIG. 6 is an exploded view of the water sports binding shown in FIG. 5, wherein the soft upper portions are removed for clarity.

A second embodiment of a binding 200 in accordance with the present invention is shown in FIGS. 5-10. FIG. 5 is a perspective view of the binding 200 showing the structural components and wherein the flexible upper assembly 250 is shown in phantom to better illustrate other novel aspects of the binding 200. FIG. 6 shows an exploded view of the binding 200 without the upper assembly 250. The binding 200 includes a substantially rigid base plate 210 that is adapted to be mounted on a water sports board (not shown). The base plate 210 has a front or toe end 209 and a back or heel end 213. For convenience, the base plate 210 may include a separable toe cup portion 211 defining an upright wall 207 about the front end 209 of the base plate 210.

In a current embodiment, the base plate 210 is formed from a composite material, such as a glass-filled nylon composite, although other suitable materials may be used and are within the skill in the art to identify, including for example aluminum, aluminum alloy or relatively rigid plastic. The base plate may include any number of lightening holes 208, to reduce the weight of the base plate 210. Although not shown in FIG. 5, it is contemplated that a vibration-absorbing pad will typically underlie the base plate 210, i.e., between the base plate 210 and the water sports board.

In a current embodiment, the base plate 210 may be selectively mounted at a different angular position on the sports board, and adjusted using conventional attachment hardware (not shown). A relatively thick and compliant foot pad 212 is disposed on top of the base plate 210, which may comprise a closed-cell polymeric foam or the like.

The base plate 210 further comprises a generally U-shaped rigid heel cup 215 that extend upwardly from the base plate 210. In the current embodiment the heel cup 215 extends along at least a portion of the medial side of the base plate 210, about the heel end 213 and along at least a portion of the medial side of the base plate 210. Although in the present embodiment the base plate 210 and heel cup 215 are integrally formed, it is contemplated that the binding may alternatively be constructed with a separately-formed heel cup that is attached to the base plate by conventional means. The heel cup 215 includes an optional slot 219 near the back end, the purpose of which is discussed below.

A rigid arcuate heel loop 240 is pivotably attached to the heel cup 215. The heel loop 240 includes oppositely-disposed mounting apertures 251, and a center portion having a locking recess 238 disposed on a lower surface. Lateral and medial pivot members 241 extend through corresponding apertures 217 in the heel cup 215, to pivotably attach the heel loop 240 to the heel cup 215. The heel loop 240 may be formed from any suitable material, for example, from a glass-filled nylon composite, aluminum or the like.

Figure 7:
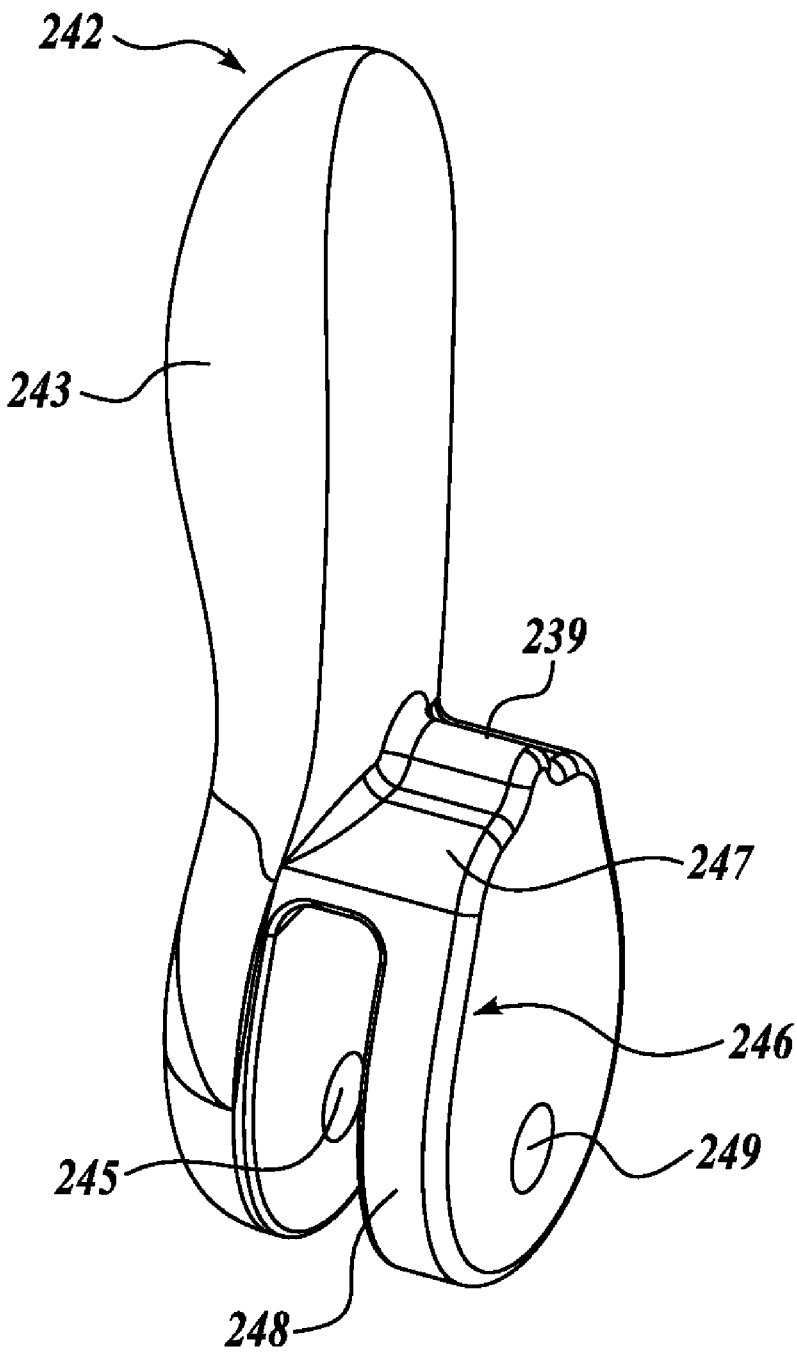
FIG. 7 is a perspective view of the adjustment control lever for the water sports binding shown in FIG. 5.

A cam and lever-type adjustment control 242 is pivotably attached to a rearward end of the heel cup 215 with a pivot member 244. Refer now also to FIG. 7, which shows the adjustment control 242 in isolation. The adjustment control 242 includes a lever 243 having an aperture 245 at a proximal end that receives the pivot member 244. The lever 243 is attached to, or co-formed with, a cam 246. The cam 246 comprises an eccentric portion 247 disposed away from the pivot member 244, and a spaced leg portion 248 depending from the eccentric portion 247. In the current embodiment, the eccentric portion 247 of the cam 246 includes a locking tab 239.

The spaced leg portion has 248 an aperture 249 aligned with the lever aperture 245 that also receives the pivot member 244. The rear end of the heel cup 215 is substantially flat, and the lever 243 and the spaced leg portion 248 of the cam 246 straddle the flat end of the heel cup 215. The pivot member 244 extends through the three apertures 245, 251, 249.

Figure 8A:
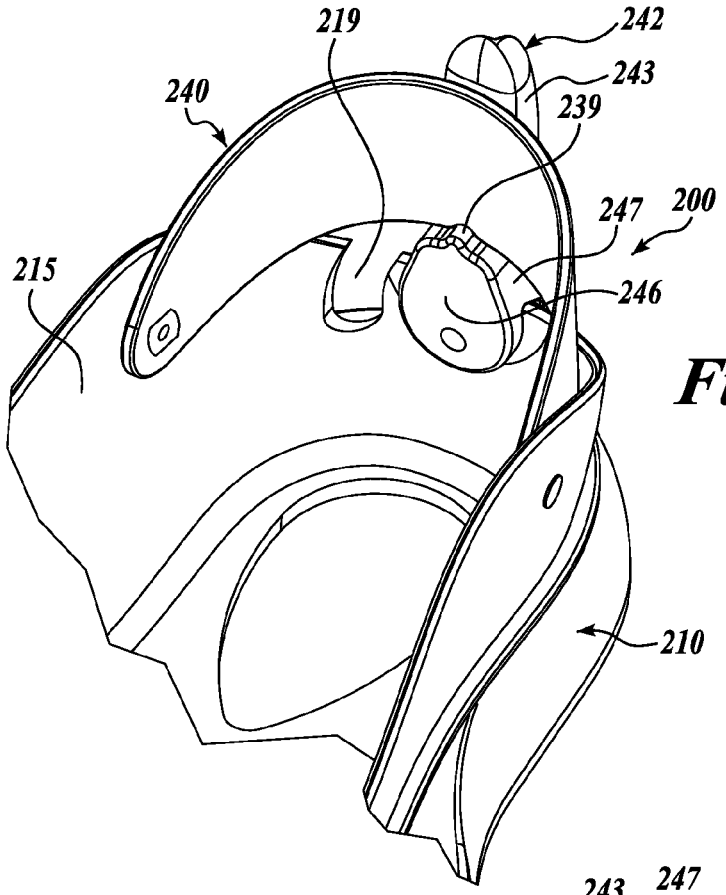
FIGS. 8A and 8B are fragmentary perspective views of the water sports binding shown in FIG. 5, showing the adjustment control lever in different positions.
Figure 8B:
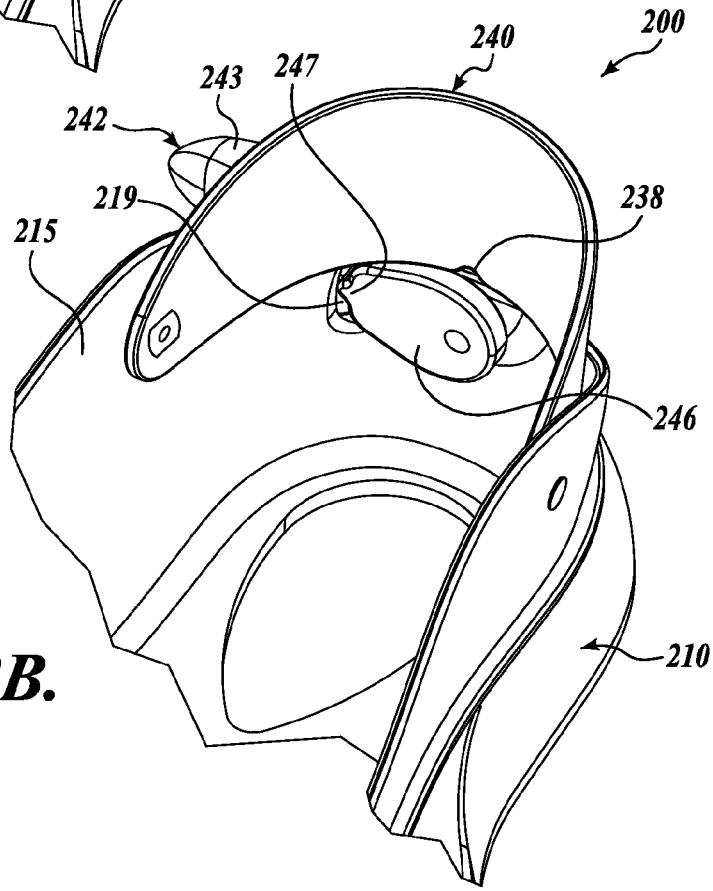

When the binding 200 is assembled as shown in FIG. 5, the cam 246 of the adjustment mechanism 242 is disposed beneath a lower edge of the heel loop 240. Refer now also to FIGS. 8A and 8B, which show fragmentary perspective views of the structural portions of the binding 200 with the adjustment mechanism 242 in different positions. The adjustment mechanism 242 is pivotable between a first or support position (FIG. 8A) and a second or release position (FIG. 8B). In the support position shown in FIG. 8A the cam 246 supports and holds the heel loop 240 in an upper support positions. In the release position shown in FIG. 8B the heel loop 240 is not held in the upper support position.

It will now be appreciated that the slot 219 in the heel cup 215 is positioned and oriented to receive the eccentric portion 247 of the cam 246 when the adjustment control 242 is moved to the release position. It will also be appreciated that the locking tab 239 on the cam 246 is sized and shaped to engage the corresponding recess 238 on the lower edge of the heel loop 240 when the adjustment control 242 is in the support position.

Figure 9:
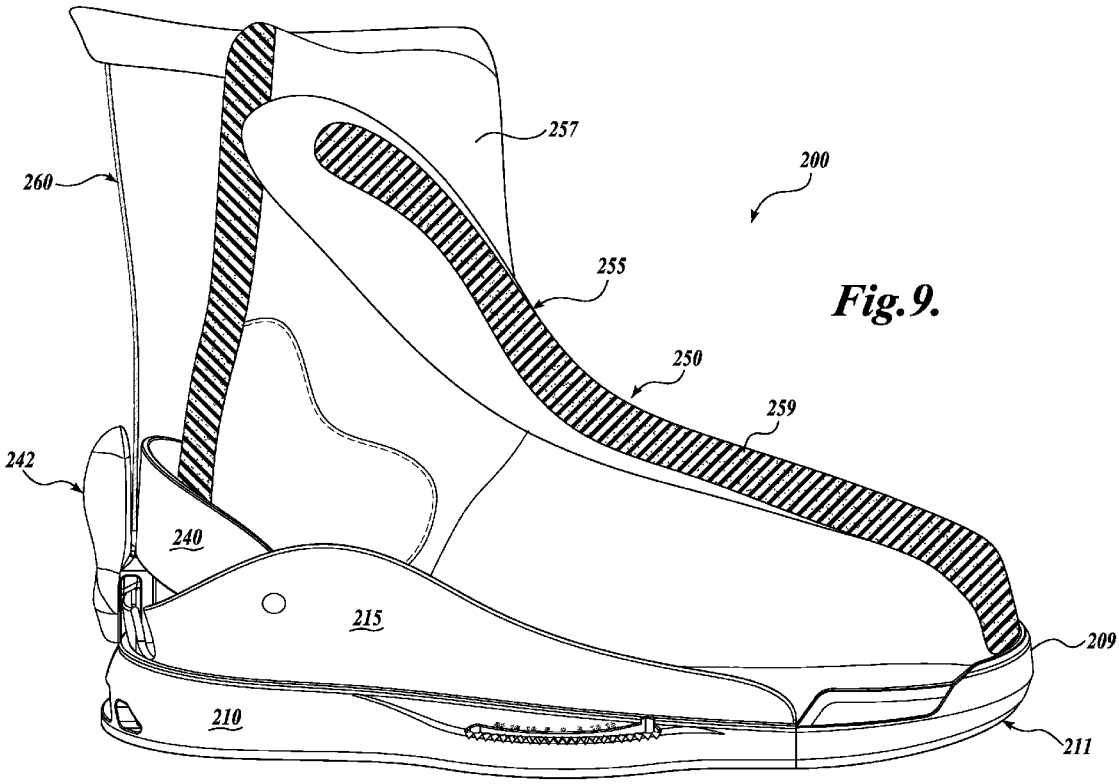
FIG. 9 is a partially cross-sectioned side view of the water sports binding shown in FIG. 5.

FIG. 9 is a partially cutaway side view of the binding 200, showing additional details of the upper assembly 250 for the currently preferred embodiment. In this embodiment, a relatively thick and soft liner 255 encloses the user's foot. The liner 255 may be formed from a closed-cell polymeric foam or the like. The liner 255 extends generally from the front end 209 of the base plate 210 and about the user's foot including over the instep and about the ankle. The liner 255 provides comfort to the user's foot and ankle, and may be of unitary construction or be formed in multiple parts, such as separate front and back panels. The liner 255 may be removable from the structural components or permanently affixed thereto. An ankle portion 257 of the liner 255 is disposed generally about the user's ankle, and a foot portion 259 is disposed generally about the user's foot and instep. The liner 255 is disposed between the user's foot and structural components of the binding such as the heel cup 215 and the heel loop 240.

Figure 10:
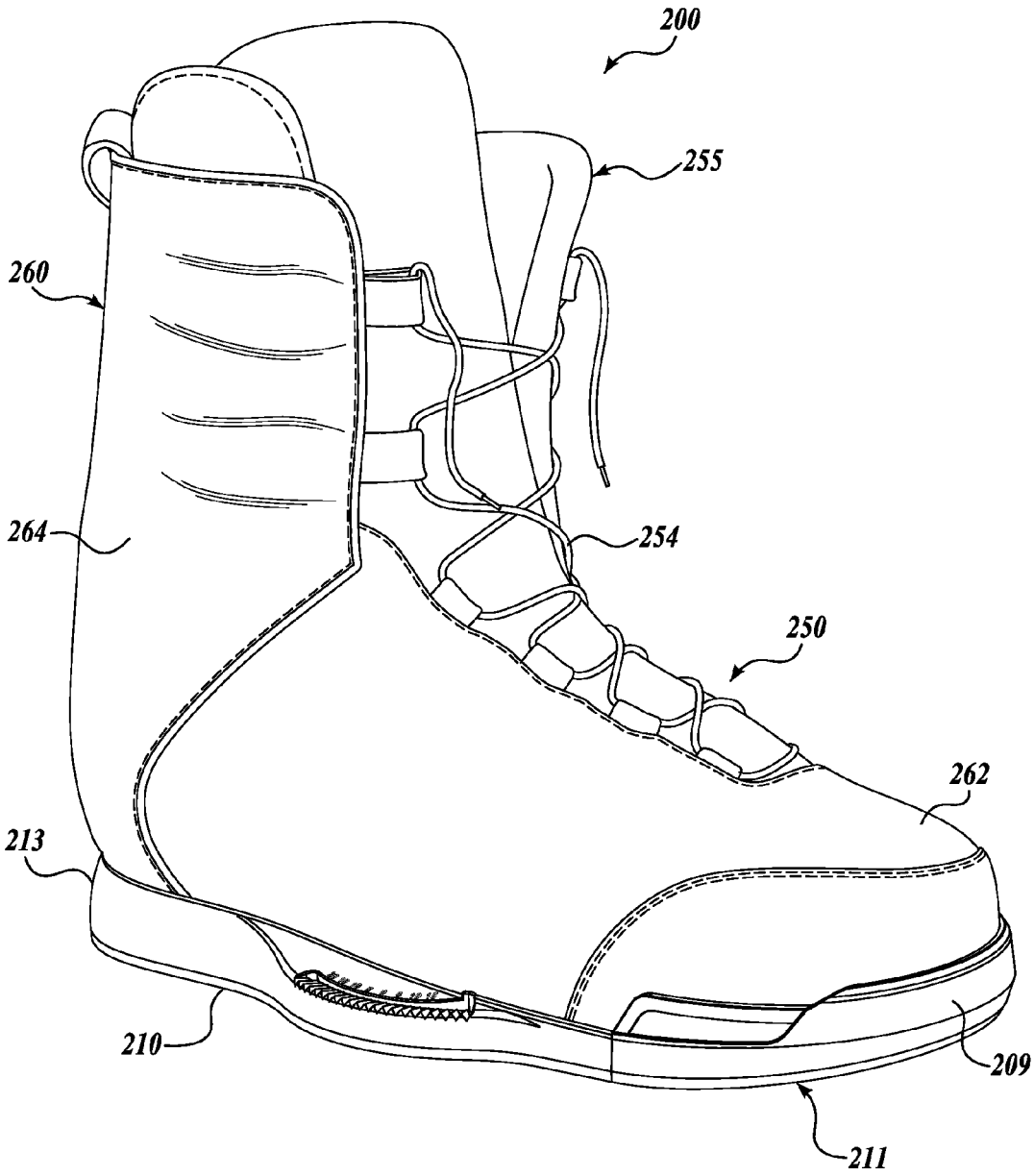
FIG. 10 is a perspective view of the assembled water sports binding shown in FIG. 5.

Refer also to FIG. 10, showing a perspective view of the assembled binding 200. A relatively thin and tough overlay 260 substantially encloses the soft liner 255 and may include a lace and keepers 254 or other conventional attachment mechanism for securing and selectively controlling and tightening the fit about the user's foot, as are well known in the art. The overlay 260 may be formed from any suitable material, for example from a flexible polymeric panel or the like. In a current embodiment, the overlay 260 comprises a toe overlay 262 that generally overlies the user's forefoot and extends about the sides of the user's foot, and a separate heel and ankle overlay 264 that is disposed about the user's heel and ankle. The overlay 260 is fixedly attached to the base plate 210, for example by stitching or adhesive attachment to the heel cup 215 and toe cup 211. The heel and ankle overlay 264 may overlap the toe overlay 262 to facilitate flexure of the user's ankle.

Although in the currently preferred embodiment, the overlay 260 is fixedly attached to the heel cup 215, it will be appreciated from the present disclosure, and in particular with reference to the first embodiment of a binding 100 described above, that the heel and ankle overlay 260 may alternatively be affixed to the heel loop 240, such that when the adjustment control 242 is moved to the release position (FIG. 8B) the heel and ankle overlay 260 will tend to pivot rearwardly, facilitating entry in to the binding 200.

When using a water sports binding such as binding 200, a user may desire to have greater or lesser support about the heel, for reasons of performance, control and/or comfort. With the binding 200, a user may adjust the support about the user's heel by grasping the lever 243 and pivoting the adjustment control 242 between the support and release positions shown in FIGS. 8A and 8B, respectively. In the support position the heel loop 240 is pivoted upwardly providing greater support about the user's foot and ankle. In the release position the heel loop can pivot downwardly providing greater flexibility to the user's ankle.

In addition, it will be appreciated that entry and exit from a conventional water sports binding may be difficult particularly when trying to engage or disengage from the binding while floating in the water. With the present binding 200, a user may move the adjustment control 242 to the release position to facilitate entry or exit from the binding 200.

Figure 11:
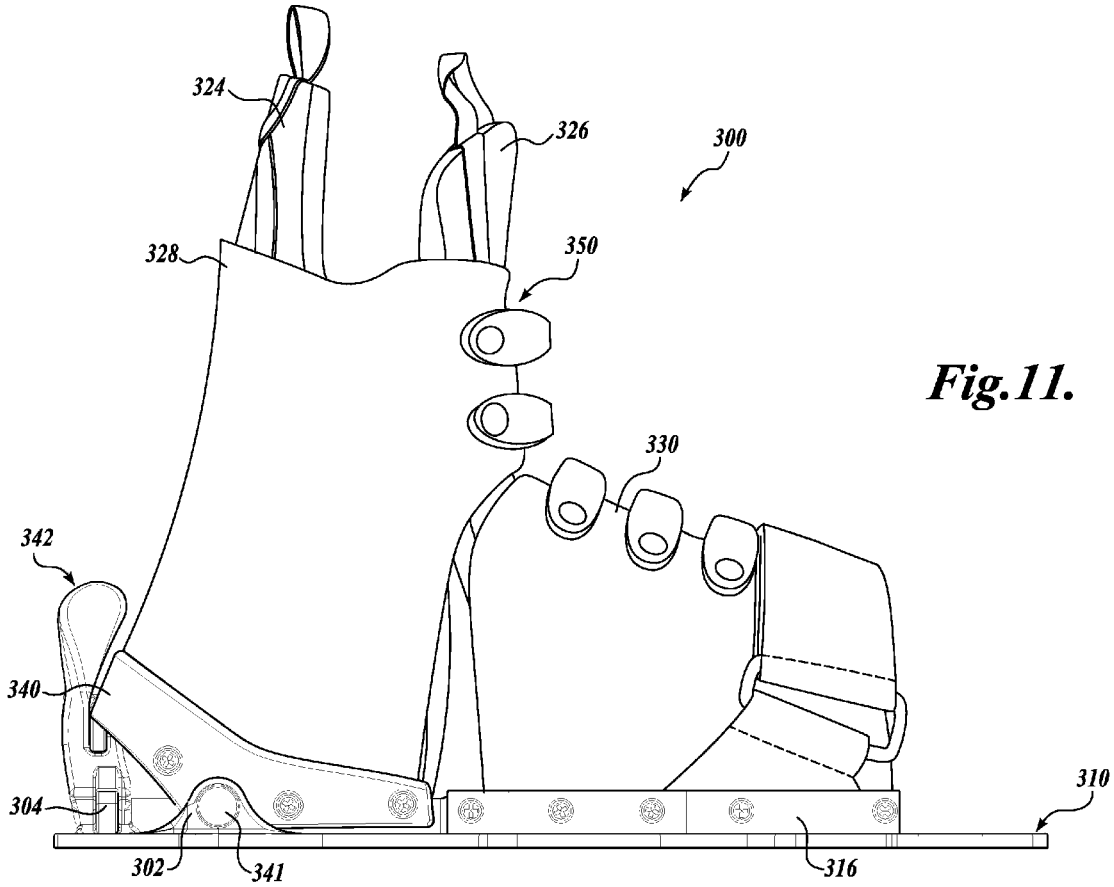
FIG. 11 is a side view of a third embodiment of a water sports binding in accordance with the present invention, shown in a support position.
Figure 12:
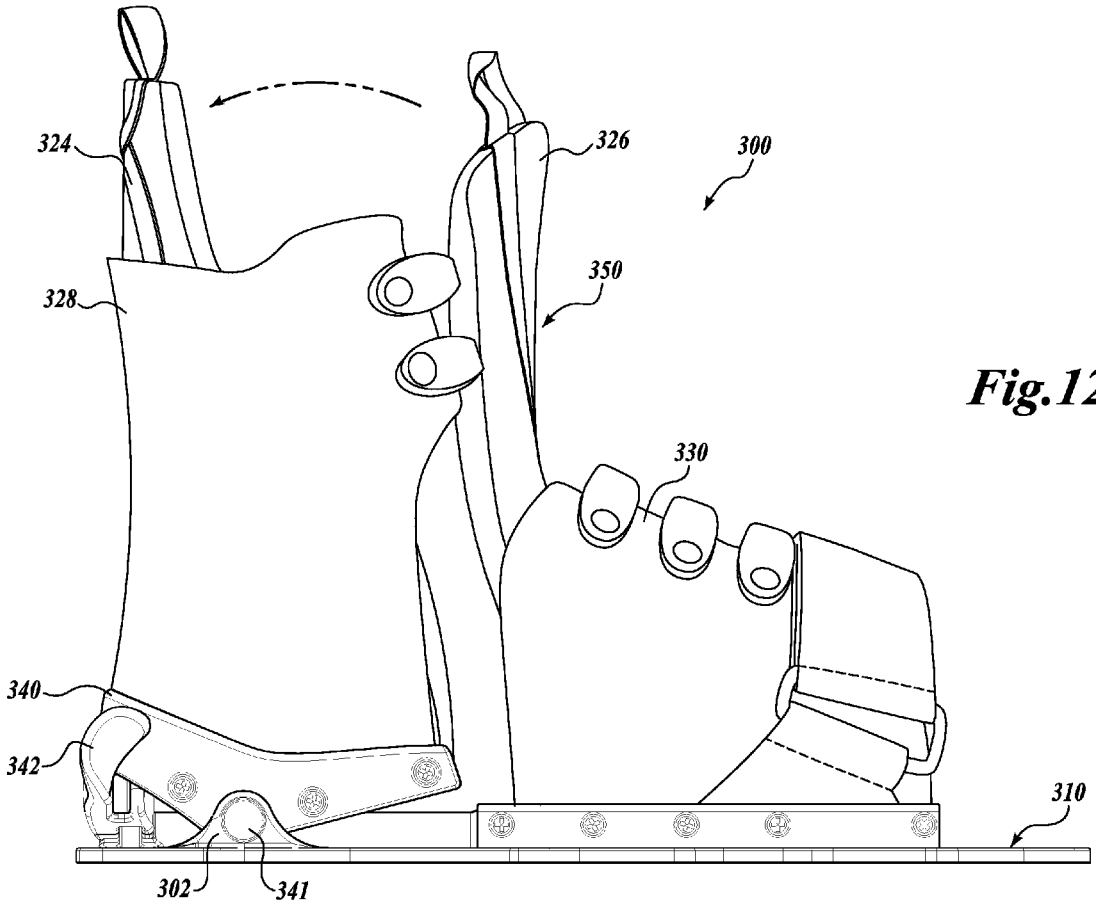
FIG. 12 is a side view of the water sports binding shown in FIG. 11, with the binding in the release position

A third embodiment of a water ski binding 300 in accordance with the present invention is shown in FIGS. 11-14B. FIG. 11 is a side view of the binding 300, shown in the support position and FIG. 12 is a similar view showing the binding 300 in the release position. The binding 300 includes a base plate 310 that is adapted for attachment to a water sports board (not shown). A heel loop 340 is pivotably attached to the base plate 310 through oppositely-disposed lugs 302 (one visible), and pivots 341.

A flexible upper portion 350 is attached to a base plate 310, similar to the first embodiment above, and may include a front panel 326 and an instep support 330 that are attached at a forward portion of the baseplate 310, for example with attachment rails 316. A back panel 324 and ankle support 328 are attached to the heel loop 340.

The pivotably heel loop 340 engages an adjustment control 342 that is pivotably attached to the base plate 310 through transverse lug 304. In the support position shown in FIG. 11 the adjustment control 342 is in an upright position, which supports the heel loop 340 in a position for engaging a user's foot. In the release position shown in FIG. 12, the adjustment control 342 is pivoted down such that the heel loop 340 can pivot rearwardly, allowing the user to more easily enter or release from the binding 300.

Figure 13:
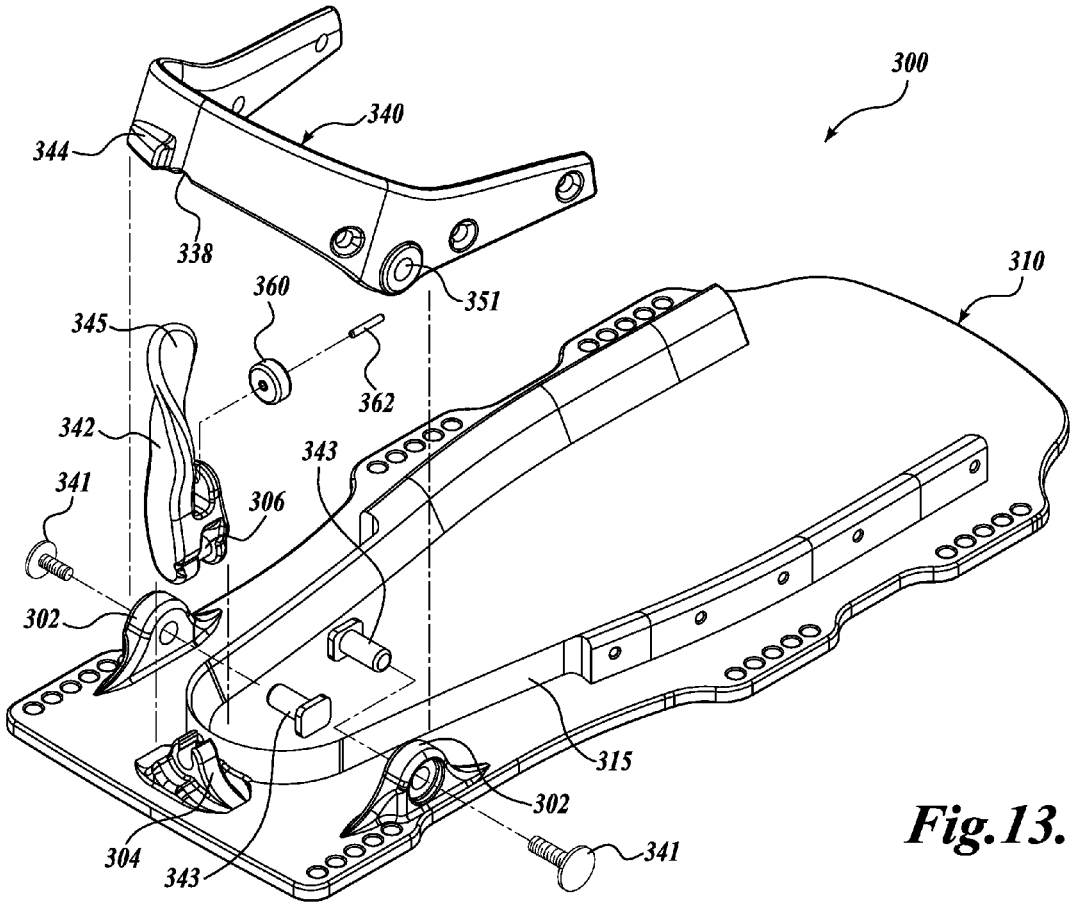
FIG. 13 is an exploded view of the hard components of the water sports binding shown in FIG. 11.

Referring now to FIG. 13, which shows a partial exploded view of the binding 300 wherein the flexible upper portion 350 is removed for clarity. The base plate 310 includes an optional short sidewall 315 that extends generally about the rear of the user's foot. The heel loop 340 attaches to the oppositely disposed lugs 302 with pivots 341 that engage nut plates 343. Other attachment means may be used, as are well known in the art. An optional stop 344 is formed on the back side of the heel loop 340, generally adjacent a recess 338.

The adjustment control 342 pivotably attaches to the transverse lug 304, for example with an integral pivot 306. The adjustment control 342 further includes a lever portion 345 for pivoting the adjustment control 342 between the support and release positions, and a heel loop engagement piece, such as wheel 360 that is rotatably attached to the lever portion 345 with pivot 362.

Figure 14A:
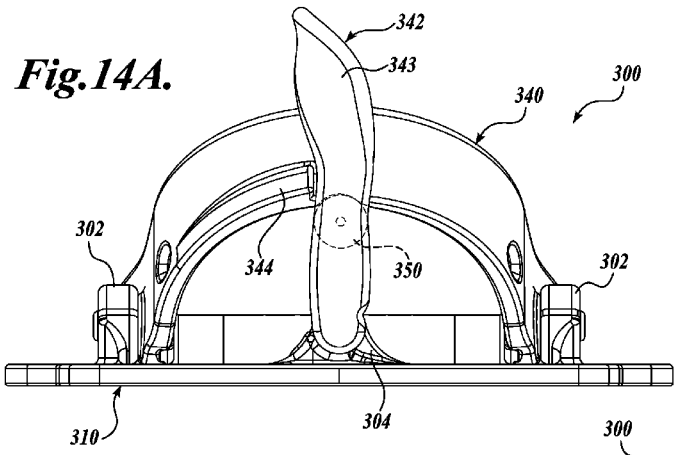
FIGS. 14A and 14B are rear views of the water sports binding shown in FIG. 11, with the soft components removed for clarity, and showing the binding in the support and release positions respectively.
Figure 14B:
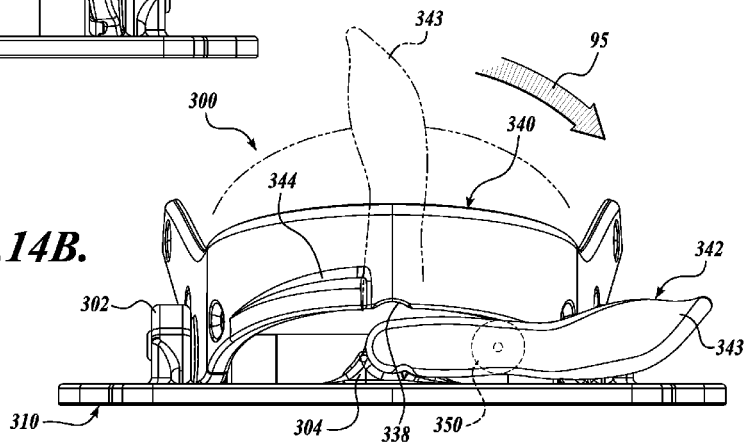

FIG. 14A shows a rear view of the binding 300 with the flexible upper 350 removed for clarity, and showing the adjustment control 342 in the support position. The lever 343 is moved to the upright position, such that it abuts the stop 344 formed on the heel loop 340, and the wheel 360 engages the recess 338. FIG. 14B shows the same view, with the adjustment control 342 pivoted to the release potion, as indicated by the arrow 95. In the release position the heel loop 340 is free to pivot rearwardly, as discussed above.

While illustrative embodiments have been illustrated and described, it will be appreciated that various changes can be made therein without departing from the spirit and scope of the invention.

The embodiments of the invention in which an exclusive property or privilege is claimed are defined as follows:

1. A binding for releasably attaching a user's foot to a water sports board, the binding comprising:

a rigid base plate;

an arcuate heel loop pivotably attached to the base plate and positioned to extend around a back portion of a user's foot, the heel loop being pivotable between an upper position and a lower position;

a flexible upper assembly attached to the base plate; and an adjustment control movable between a support position wherein the heel loop is supported in the upper position, and a release position wherein the heel loop is not supported in the upper position, wherein the adjustment control comprises a lever with a cam that is pivotably mounted to the base plate such that the cam underlies the heel loop, and wherein the cam engages a bottom edge of the heel loop such that moving the adjustment control from the release position to the support position moves the heel loop from the lower position to the upper position.

2. The binding of claim 1, wherein the cam comprises an eccentric portion that depends away from the lever and a spaced leg portion that depends away from the eccentric portion.

3. The binding of claim 1, wherein the cam further comprises a locking tab, and the heel loop further comprises a locking recess, wherein the locking tab engages the locking recess when the adjustment control is in the support position.

4. The binding of claim 1, wherein the base plate further comprises a heel cup and the adjustment control is pivotably attached to the heel cup, the heel cup including a slot that is sized and positioned to receive the cam when the adjustment control is in the release position.

5. The binding of claim 1, wherein the upper assembly comprises an inner liner portion and an outer overlay.

6. The binding of claim 5, wherein the inner liner portion is disposed inwardly from the heel loop, and the outer overlay is attached to the base plate.

7. The binding of claim 1, wherein the base plate further comprises a transverse lug, and wherein the adjustment control is pivotably attached to the transverse lug.

8. The binding of claim 1, wherein the cam comprises a rotatable wheel that engages the heel loop.

9. The binding of claim 1, wherein the base plate is formed from a composite material.

10. A binding for releasably attaching a user's foot to a water sports board, the binding comprising:

a base plate having a heel portion and a toe cup;

a heel loop pivotably attached to the base plate wherein the heel loop pivots between a release position wherein a rearward portion of the heel loop is disposed toward the base plate, and a support position where the rearward portion of the heel loop is disposed relatively farther away from the base plate;

a flexible upper assembly attached to the base plate; and an adjustment control mechanism pivotably attached to the base plate and having a lever with a cam portion, wherein the cam portion engages a bottom edge of the heel loop; and wherein the adjustment control mechanism is pivotable between a first position wherein the adjustment control mechanism supports the heel loop in the support position and a second position wherein the adjustment control mechanism does not support the heel loop and the heel loop is in the release position.

11. The binding of claim 10, wherein the base plate further comprises a heel cup extending upwardly from the heel portion of the base plate and the lever is pivotably mounted to the heel cup such that the cam portion underlies the heel loop.

12. The binding of claim 11, wherein the cam portion comprises an eccentric portion that depends away from the lever and a spaced leg portion that depends away from the eccentric portion, and further wherein the adjustment control mechanism straddles the back end of the heel cup.

13. The binding of claim 11, wherein the heel cup includes a slot that is sized and positioned to receive the cam portion when the adjustment control mechanism is in the second position.

14. The binding of claim 10, wherein the cam portion further comprises a locking tab, and the heel loop further comprises a locking recess, wherein the locking tab engages the locking recess when the adjustment control mechanism is in the second position.

15. The binding of claim 10, wherein the upper assembly comprises an inner liner portion and an outer overlay.

16. The binding of claim 15, wherein the inner liner portion is disposed inwardly from the heel loop, and the outer overlay is attached to the base plate.

17. The binding of claim 10, wherein the base plate is formed from a composite material

* * * * *